United States Patent [19]

Grass

[11] Patent Number: 4,841,598

[45] Date of Patent: Jun. 27, 1989

[54] FURNITURE HINGE

[75] Inventor: Alfred Grass, Höchst, Austria

[73] Assignee: Alfred Grass Ges. mbH. Metallwarenfabrik, Hoechst/Vlbg., Austria

[21] Appl. No.: 200,379

[22] Filed: May 31, 1988

[30] Foreign Application Priority Data

Apr. 11, 1988 [AT] Austria ..... 937/88

[51] Int. Cl.[4] ..... E05D 7/12; E05F 1/12

[52] U.S. Cl. ..... 16/251; 16/257; 16/296; 16/302; 16/370

[58] Field of Search ..... 16/251, 257, 261, 270, 16/296, 302, 370, 382, DIG. 40, DIG. 43

[56] References Cited

FOREIGN PATENT DOCUMENTS

| | | |
|---|---|---|
| 168595 | 1/1986 | European Pat. Off. . |
| 1801308 | 8/1969 | Fed. Rep. of Germany . |
| 2539197 | 10/1976 | Fed. Rep. of Germany . |
| 2806958 | 8/1978 | Fed. Rep. of Germany . |

*Primary Examiner*—Nicholas P. Godici
*Assistant Examiner*—Edward A. Brown

[57] ABSTRACT

A furniture hinge is described which comprises a hinge base, and a hingeable arm arrangement adjustably connected to a hinge bracket which is clipped onto the hinge base. The hinge base is attached to a piece of furniture adjacent a door thereof, and the arm arrangement is attached to the door thereof.

The invention provides a clip-on arrangement which may be easily operated, requires only a few parts, and operates reliably. In this respect, the hinge base has front and rear extensions projecting away from the base in opposite longitudinal directions. The hinge bracket has a U-shaped cross-section formed by two lateral limbs and a front base limb. The front extensions on the base, which are situated adjacent the door, pivotally engage the front base limb of the U-shaped hinge bracket, and the rear ends of the lateral limbs remote from the door are provided with spring catches which resiliently snap-lock onto the rear extensions of the base.

14 Claims, 6 Drawing Sheets

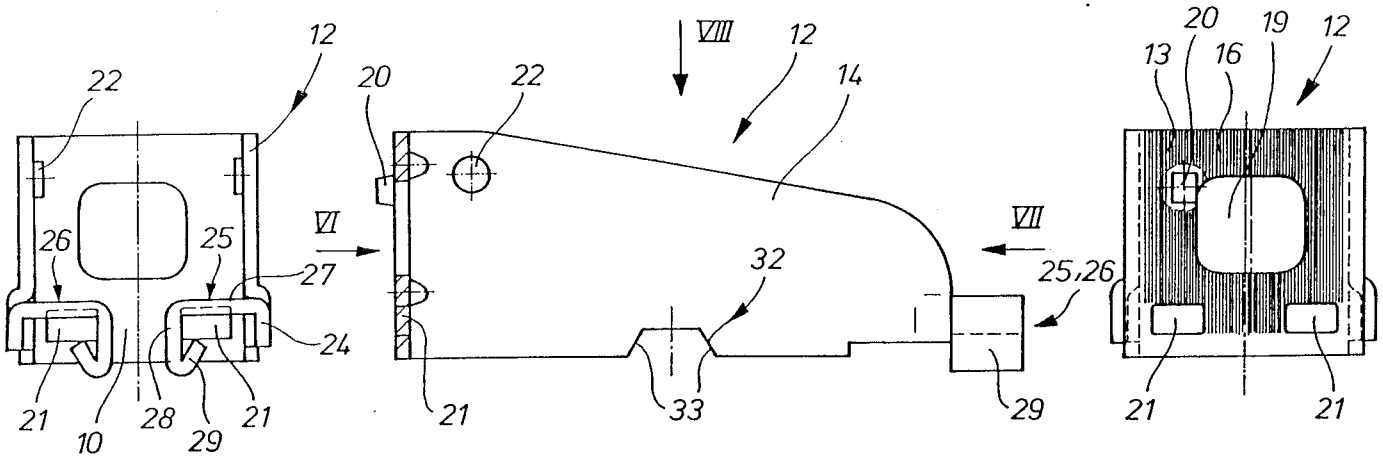
FIG 6
FIG 5
FIG 7
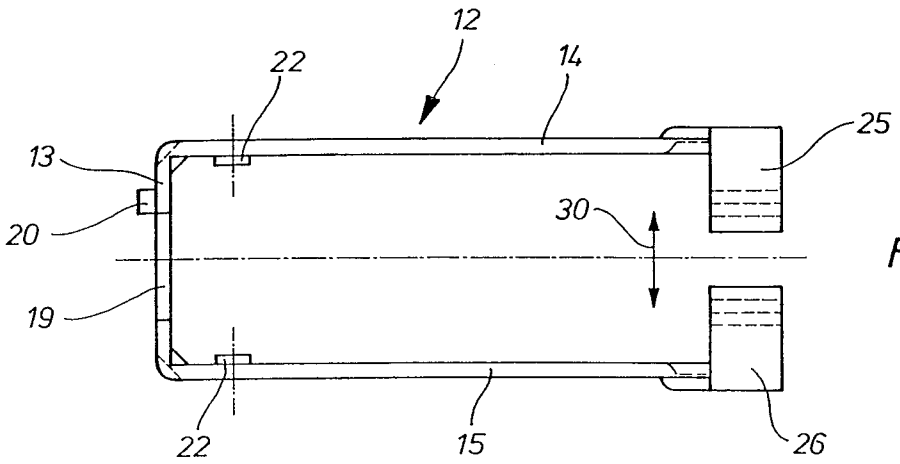
FIG 8

31
25,26
3
14
1
12
33
22
21
2
35
34
5
4
32
11
9
36
29
15
26

FURNITURE HINGE

BACKGROUND OF THE INVENTION

The invention relates to a furniture hinge comprising a hinge base intended to be secured to a first part of a piece of furniture, for example a stationary part thereof, a hinged arrangement, such as hinged arms, being hingedly carried by the base and intended to be secured to a second part of the piece of furniture, for example a door thereof.

More particularly, the invention relates to a hinge of the type in which the base includes a base member such as a plate intended to be secured to the first furniture part, a connector such as a stirrup or bracket, and means for attaching or clipping the connector to the base member, the hinged arrangement being carried by, and preferably adjustable relative to, the connector, and the connector being at least partly covered by a cover such as a stirrup or yoke.

Various furniture hinges of this type, incorporating clip-on means, are already known.

It is a disadvantage of known furniture hinges of this type that the clip-on means is structurally comparatively complex and difficult to operate.

BRIEF SUMMARY OF THE INVENTION

It is an object of the present invention to provide an improved clip-on means or device which is capable of being easily operated, requires few parts, and operates reliably.

According to the present invention, there is provided a furniture hinge of the foregoing type, wherein the base member or plate fixedly installed on the first part of the piece of furniture has forward and rearward extensions projecting longitudinally away from the base member, wherein the connector or bracket has a generally U-shaped cross-section formed by two lateral limbs and a forward base limb, whereby the connector may be clipped onto and pivot relative to the forwardly projecting extensions of the base member situated adjacent the second part or door of the piece of furniture, and wherein the U-shaped connector also has rearward spring catches situated at a distance from the door, by which the connector may be clipped to the rearwardly projecting extensions of the base member.

Basically, the connector has its base limb or front portion pushed onto the forward extensions of the base plate, and has its rear portion engaged by means of spring catches with the rearward extensions of the base plate which are symmetrically formed with respect to the forward extensions.

In one embodiment of the invention, the base plate is formed symmetrically. As a result, it is immaterial in which direction, i.e. which way round, the base plate is installed on the piece of furniture.

The base plate advantageously has central embossed or equivalent raised portions having shoulders which are arranged to come into contact with locating shoulders of corresponding trapezoidal recesses or cut-outs in the connector. As a result the connector will slide rearwardly in the longitudinal direction upon being clipped or snapped on.

The base plate extensions advantageously have inclined or tapered lead-in surfaces. This facilitates the clip-on operation.

Centering studs or equivalent, for lateral location of the limbs of the connector, are advantageously provided on the surface of the base plate. The connector is thereby also located laterally in an advantageous manner as it is being pushed on to the base plate.

Provision is made, in a preferred embodiment, for the connector to have two recesses in its base limb, and horizontal spring catches in its rearward portion which merge into angled-over end portions via upright portions, the end portions being engageable beneath said rearward extensions.

An easily operated clip-on device is thus advantageously formed, the spring catches being bent out of the lateral limbs of the connector in a relatively uncomplicated manner.

Preferably, the connector also has lateral open areas at its rearward extremity of the lateral limbs, in the region of the centering studs of the base plate. This assures that the rearward portions of the lateral limbs of the connector are free to spring laterally inwardly and outwardly.

Provision is made in one embodiment for the ends of the cover yoke to be engageable over the connector, the cover yoke including a securing boss, stud or the like, and extensions which merge into detent shoulders. The cover yoke cooperates with the connector to lock the latter in place on the base plate, and also gives the hinge system an attractive appearance.

The cover yoke or portion preferably incorporates a hinge in its front region, and extensions having detent grooves which may be clipped on to studs or equivalent of the connector. Upon doing so, another clip-on operation is performed in an uncomplicated manner, the cover yoke simultaneously securing the connector.

One embodiment of the invention will now be described with reference to the accompanying drawings.

BRIEF DESCRIPTION OF THE SEVERAL VIEWS OF THE DRAWINGS

FIG. 5 is a longitudinal section through the connector of the hinge of FIG. 1;

FIG. 6 is an end view of the connector, in the direction of the arrow VI in FIG. 5;

FIG. 7 is a rear view of the connector in the direction of the arrow VII in FIG. 5;

FIG. 8 is a plan view of the connector in the direction of the arrow VIII in FIG. 5;

Referring to FIGS. 1 to 4, the hinge includes a base plate 1 having a pair of longitudinal extensions 2 adjacent and projecting forwardly towards the door (shown in broken lines in various hinged positions), and a pair of longitudinal extensions 3 remote from and projecting rearwardly away from the door. The two extensions of each pair are mutually parallel and are spaced apart laterally, and the extensions 2 are analogous, for example identical, to the extensions 3.

The base plate is symmetrical about its central longitudinal arms or plane, so that it may also be installed in a reversed position, i.e. with the extensions 3 adjacent and projecting towards the door.

Figure 3:
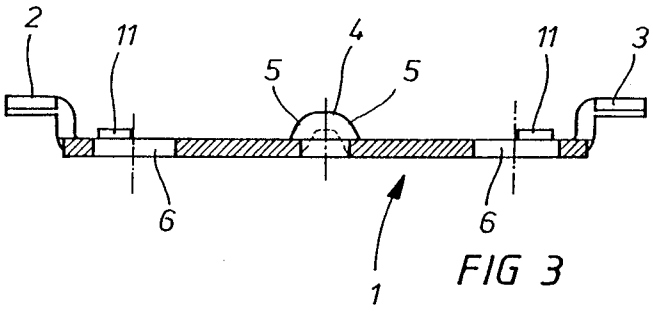
FIG. 3 is a longitudinal cross-section of the base plate.
Figure 2:
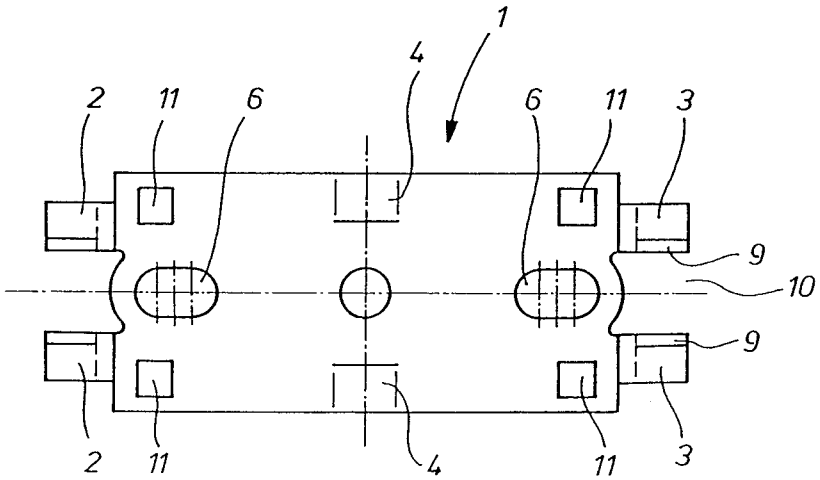
FIG. 2 is a plan view of the base plate of the hinge of FIG. 1.

Furthermore, the base plate 1 is embossed or otherwise provided with projections 4 at approximately the longitudinal centre of the plate as shown in FIGS. 2 and 3, each of the projections 4 having shoulders 5. The projections 4 are likewise of symmetrical form, each projection having one shoulder 5 at its extremity closest to the door, and another shoulder 5 at its extremity farthest from the door. As previously stated, this also allows the base plate 1 to be installed in a reversed position.

Screw holes 6 such as slots are provided in the base plate for receiving appropriate screws 7 (FIG. 1) to secure the base plate on a stationary part or section 8 of a piece of furniture. To simplify matters, only one part of the base plate will now be described in detail, because the other part is identical and symmetrical about the central longitudinal and transverse axes.

Figure 4:
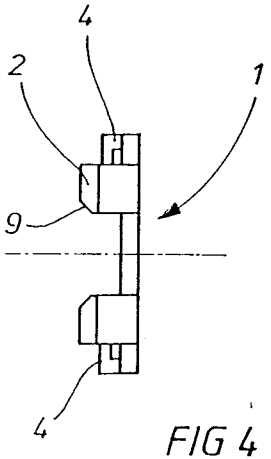
FIG. 4 is an end view of the base plate.

As shown in FIG. 4, each extension 2, 3 has an inclined lead-in surface or taper 9, the purpose of which will be explained hereinafter.

It is important that a gap 10 be formed between the extensions 3, i.e between the mutually opposed inclined lead-in surfaces 9. This gap 10 is necessary for subsequent engagement of the hinge bracket, strap or stirrup 12.

Centering studs, bosses or the like 11, which serve to centre the hinge bracket on the base 1, jointly with the projections 4, are also provided on the surface of the base plate 1.

Figure 1:
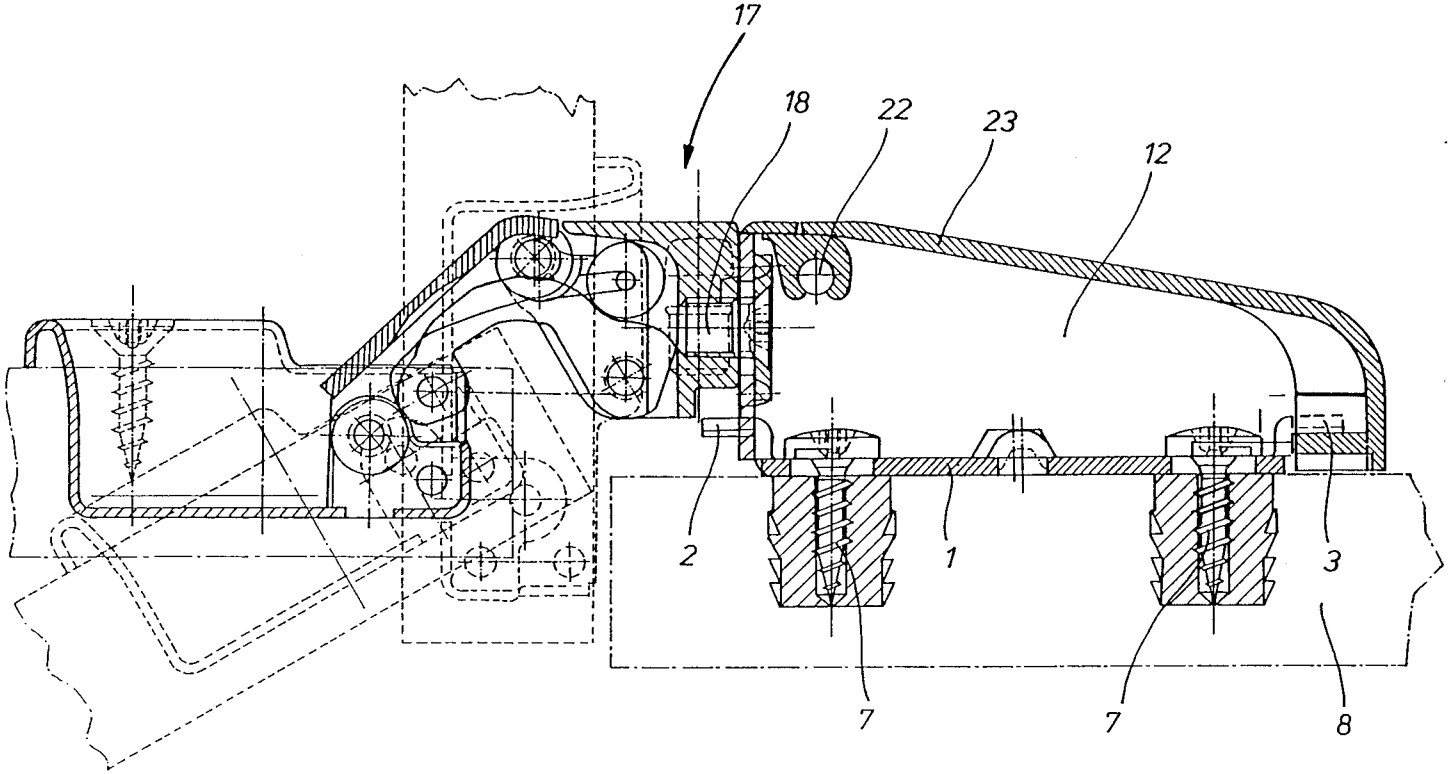
FIG. 1 is a longitudinal section through a furniture hinge embodying the invention in its installed condition.

The hinge bracket 12, as shown in FIG. 8, comprises an element which is U-shaped in cross-section or plan, having a base limb 13 and two lateral limbs 14, 15. As also shown in FIG. 6, the base limb has a ribbed, for example milled or knurled, surface 16, which forms a displacement and clamping surface for an adjusting or displacement mechanism 17 as illustrated in FIG. 1. The displacement mechanism 17 basically comprises a vertically adjustable clamping screw 18. The clamping screw 18, when loosened, allows displacement of an appropriate clamping plate in the direction of the longitudinal ribbing or milling of the milled surface 16. This screw 18, which is illustrated in FIG. 1 by way of example only, extends through a cut-out 19 of an appropriately large size in the base limb 13 of the hinge bracket 12 as shown in FIG. 6, to assure the required path of adjustment of the moving part, i.e. hingeable means or arms, of the hinge.

A projection 20 is also punched out of, or otherwise formed on, the base limb 13 as shown in FIG. 5, which engages in an associated groove in the displacement mechanism 17, to assure a lateral displacement or guiding of the corresponding displacement mechanism.

Two recesses or cut-outs 21 (FIGS. 5 and 6) are situated one beside the other in the base limb 13, which are engaged by the extensions 2 of the base plate 1 as illustrated in FIG. 1. A pivotal connection, which acts between the hinge bracket and the base plate at the forward side or end of the system adjacent the door, is established by engagement of the extensions 2 of the base plate 1 in these cut-outs 21.

As shown in FIG. 8, inwardly mutually laterally opposed and aligned studs or bosses 22, on which a cover element or yoke strap 23 is clipped in a manner to be described later, are situated on the inner sides of the mutually opposed limbs 14, 15.

The important part of the hinge bracket 12, which is remote from the door, will now be described.

As will be apparent from FIGS. 7 and 8, curved portions 24 are formed at the extremities of the limbs 14, 15 of the hinge strap 12 remote from the door, and lugs or flaps 25, 26 are stamped out of the material of these limbs 14, 15 and bent to their final shape shown. In particular, as shown in FIG. 7, each flap 25, 26 comprises a horizontal portion 27, a vertical portion 28 and an angled-over end portion 29.

It is important that the flaps 25, 26 can be sprung towards and away from each other in the directions of the arrows 30 in FIG. 8, because the hinge bracket is formed as a U-shaped stirrup, that is removed by overcoming the spring force of the lateral limbs 24, 25 and base limb 13. It is thus possible for the flaps 25, 26 to be clipped on to the associated extensions 3 of the base plate 1 as shown in FIG. 12.

This operation is illustrated in particular in FIGS. 9 to 12.

Figures 9, 10, 11, 12:
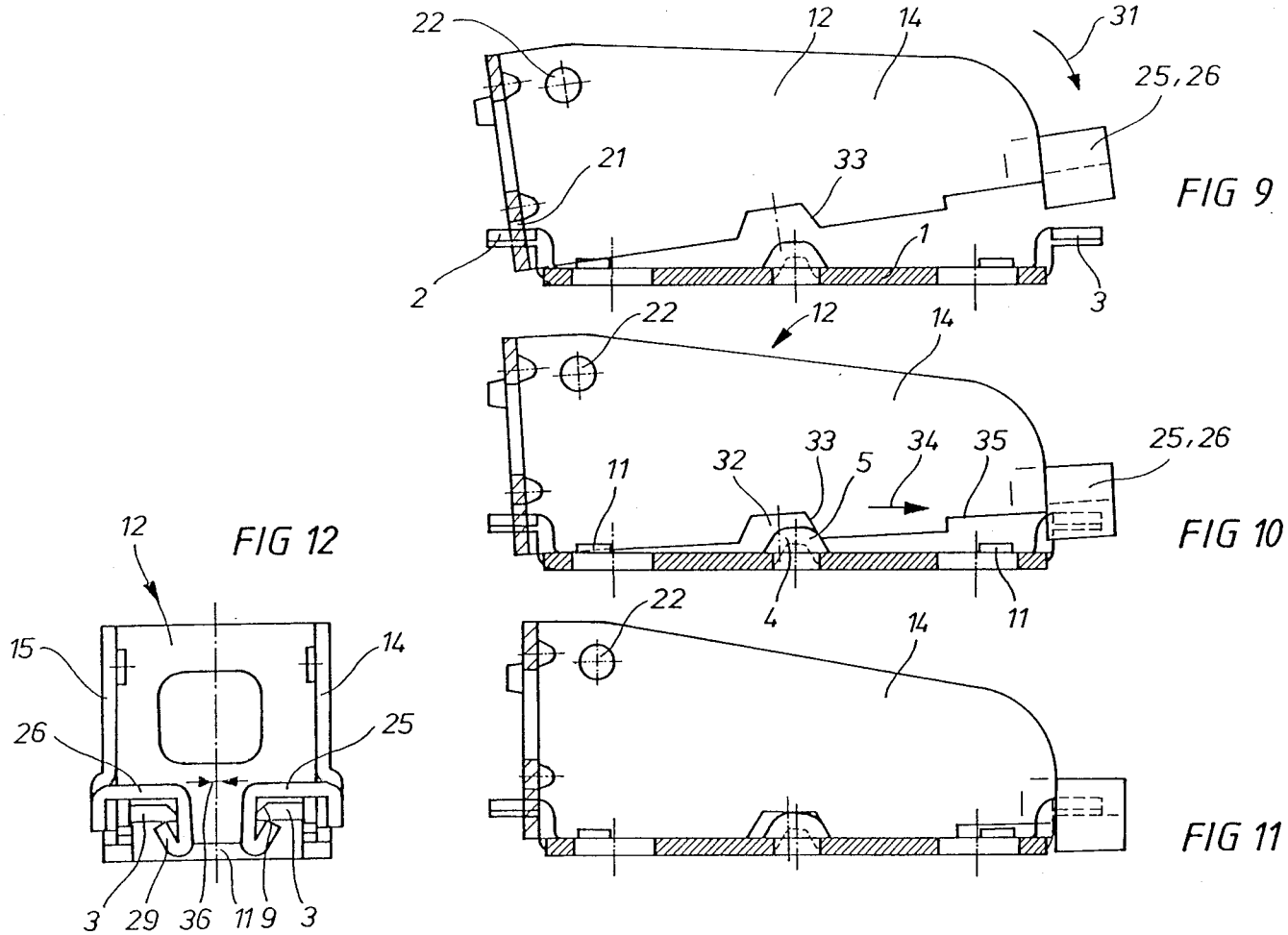
FIG. 9 shows the connector being assembled to the base plate, but prior to clipping engagement therewith.
FIG. 10 shows the connector during the clipping operation.
FIG. 11 shows the connector in its engaged or clipped position.
FIG. 12 is a rear view showing the connector clipped on the base plate.

As shown in FIG. 9, the recesses 21 in the limb of the hinge bracket 12 are first engaged over the base plate extensions 2 adjacent the door, thereby to form a pivot bearing, whereafter the hinge bracket 12 is pivoted downwardly in the direction of the arrow 31.

In this respect, it will be apparent from FIG. 10 that a trapezoidal cut-out 32, having a locating shoulder 33, is provided in the bottom lateral surface of each limb 14, 15. Each locating shoulder 33 engages the associated shoulder 5 of the underlying projection on the base plate 1 during pivotal movement, so that the hinge bracket 12 is thereby displaced longitudinally in the direction of the arrow 34 away from the door. This ensures that the flaps 25, 26 are engaged in the correct position on the extensions 3 of the base plate 1 as shown in FIG. 11.

The centering bosses 11 located at the forward end of the base plate 1 adjacent the door, serve to locate the hinge bracket 12 laterally, because the lateral limbs 14, 15 bear externally on the bosses 11.

As shown in FIG. 10, there is a gap 35 in the rear section of each limb 14, 15 in the region of the rear centering bosses 11, to ensure that the limbs are not obstructed by these bosses and the flaps 25, 26 are able to spring in the direction of the arrows 30 in FIG. 8, and in the reverse direction.

In this respect, it is important that, during the snap-engaging or clipping action, the lower or leading extremities of the angled-over portions shown in FIG. 12 should slide along the associated inclined lead-in surfaces 9 of the extensions 3, so that the flaps 25, 26 are cammed and compressed in the direction of the arrows 36 without the need for any additional operations. In particular, the angled-over portions 29 slide along the lead-in surfaces 9 of the extensions 3 and then snap apart automatically in directions opposite to the arrows 36, thereby locating the angled-over portions 29 beneath the extensions 3.

If it is required to release the snapped-in joint, this is simply accomplished by grasping the outer enlarged ends of the limbs 14, 15 with two fingers of one hand, and pressing these limbs together in the direction of the arrow 36 in FIG. 12, so that the angled-over end portions 29 are then disengaged from beneath the extensions 3.

Consequently, this represents a very uncomplicated snap-lock arrangement, which comprises the two limbs 14, 15 acting as a handle which can be easily found and operated.

Figure 13:
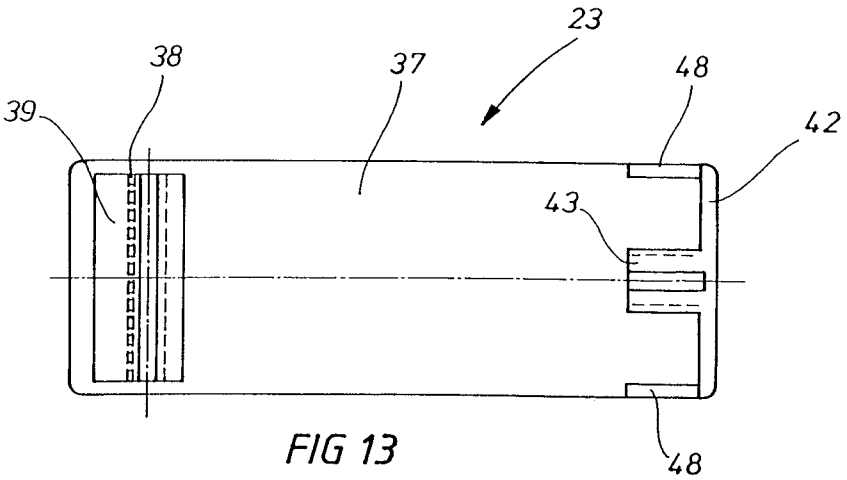
FIG. 13 is a plan view of the cover yoke of the hinge of FIG. 1.
Figure 14:
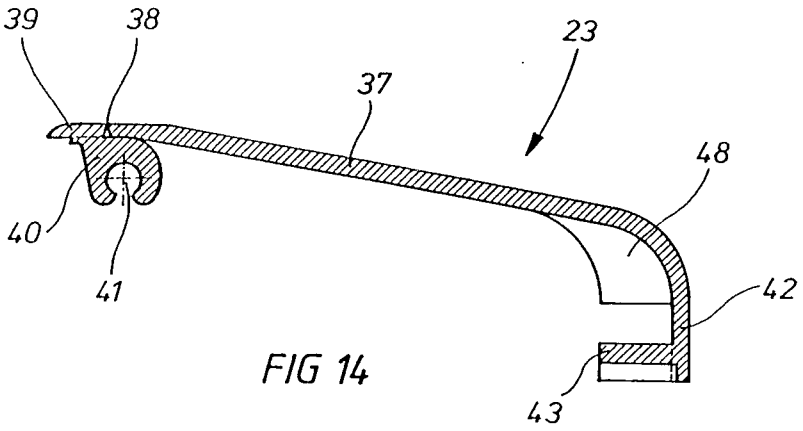
FIG. 14 is a longitudinal section through the centre of the cover yoke.

FIGS. 13 to 17 show the cover yoke 23 which serves the purpose of securing the snap-lock or detent connection described so that it cannot be released until the cover yoke 23 has been pivoted upwardly. As shown in FIGS. 13 and 14, the cover yoke 23 is made from a plastics material in the form of an elongate curved portion 37 which is pivotally joined to a stationary portion 39 via a flexible web forming a hinge 38. The stationary portion 39 has an extension 40 with a re-entrant detent groove 41 in it which can be clipped on to the bosses 22 in the limbs 14, 15 (see FIG. 1).

Figure 15:
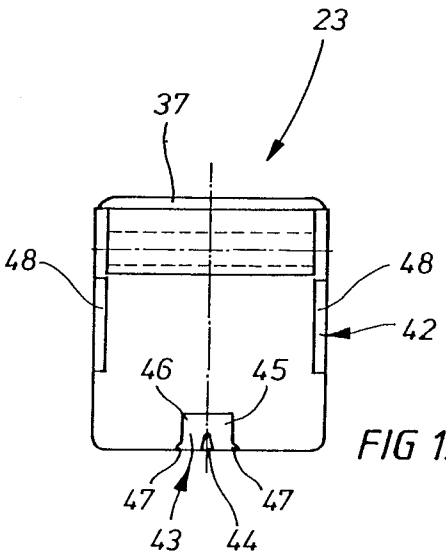
FIG. 15 is an end view of the cover yoke.

At the end remote from the door, the curved pivoted portion 37 terminates in a rear wall 42 which has an inwardly directed securing catch 43 in its lower extremity. As shown in FIGS. 14 and 15, the securing catch is a plastics element which has a lower incision 44 separating two extensions 45, 46 from each other. Each extension 45, 46 has a shoulder 47 at its lower extremity. The cover strap 42 has sidewalls 48 (FIG. 15) for laterally covering the previously described snap-lock arrangement.

Figure 16:
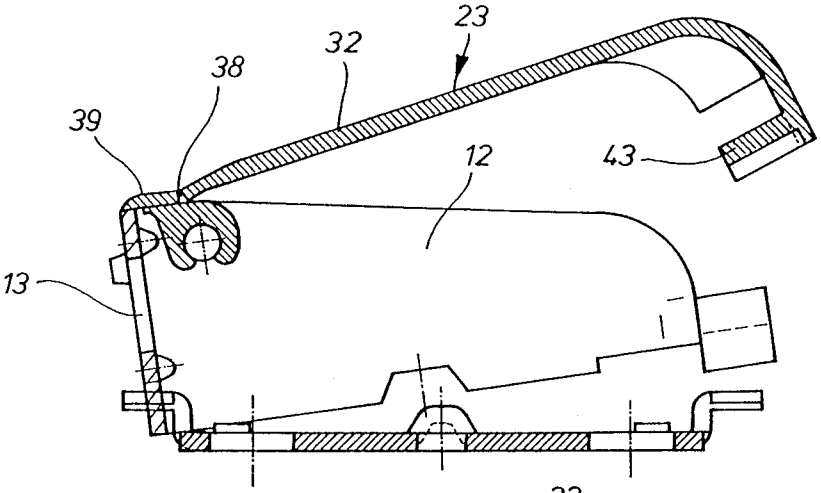
FIG. 16 is a longitudinal section showing the cover yoke and connector before being clipped onto the base plate.

The operation of the cover yoke 23 will now be described with reference to FIG. 16 to 18.

It is important that the cover yoke 23 need not be removed in its open position (see FIG. 16), because the stationary portion 39 remains securely attached to the base limb 13 of the hinge bracket 12, and since the curved portion 37 is pivotally mounted on the stationary portion 39 via the web hinge 38. To this end, the securing catch 43 is disengaged as shown in FIG. 16, i.e. it is outside the gap 10 (FIG. 18) between the rear extensions 3 of the base plate.

If the cover yoke 23 is then pivoted to its secured or covering position (FIGS. 17 and 18), it will be apparent that the securing catch 43 engages in the gap 10 between the extensions 3 of the base plate 1. The catch 43 thereby simultaneously bears against the inner side surfaces of the spring catches formed by the flaps 25, 26, that is to say in the region of the portions 28 of these spring catches 25, 26 which are upright as viewed in the drawings. This prevents the spring catches 25, 26 from accidentally moving towards each other in the direction of the arrow 36 (see FIG. 12) when this is undesirable and for as long as the cover yoke 23 is situated in its securing position.

Figure 17:
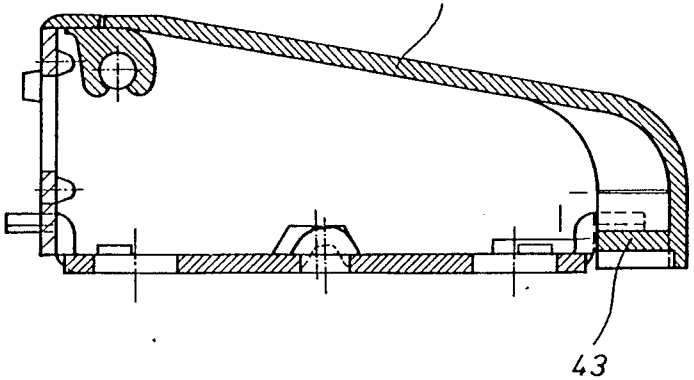
FIG. 17 is a longitudinal section showing the cover yoke and connector in their engaged or clipped position.
Figure 18:
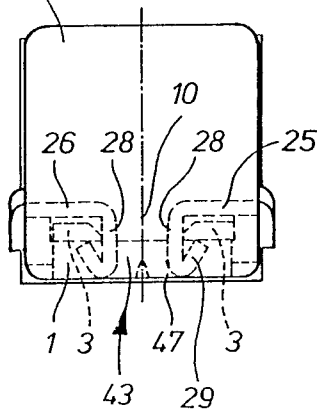
FIG. 18 is an end view showing the cover yoke and connector in their engaged or clipped position on the base plate.

In this connection, it is also important that, as shown in FIG. 18, the shoulders 47 of the extensions 45, 46 should engage beneath the angled-over portions of the spring catches 25, 26, so that, as shown in FIG. 17, a detent connection is thereby obtained, which is releasable only by overcoming the spring force of the extensions 45, 46.

Utilizing the cover yoke 23 also provides an attractive and pleasing appearance for the clip or snap-on connection, and the clip-on connection may easily be operated by means of the cover yoke.

What is claimed is:

1. A furniture hinge comprising a hinge base, and a hingeable arm arrangement adjustably connected to a hinge bracket which is clipped onto the hinge base, the hinge, in use, being installed with the hinge base attached to a piece of furniture adjacent a door thereof, and the arm arrangement attached to the door thereof, wherein the hinge base is provided with front and rear extensions projecting away from the hinge base in generally longitudinal directions, wherein the hinge bracket has a generally U-shaped cross-section formed by two lateral limbs and a front base limb whereby it can be clipped and pivotally secured onto the front extensions which, in use, are situated adjacent the door, and wherein the generally U-shaped hinge bracket also has a rear spring catch at the rear of each lateral limb which, in use, are situated remote from the door, by means of which the hinge bracket can be clipped onto the rear extensions of the hinge base.

2. A furniture hinge according to claim 1, wherein the hinge base comprises a plate member having longitudinal and transverse axes, the plate member being symmetrical about said axes.

3. A furniture hinge according to claim 1 or 2, wherein the hinge base is centrally provided with raised portions having shoulders which contact locating shoulders defined by trapezoidal openings in the hinge bracket.

4. A furniture hinge according to claim 1, 2 or 3, wherein the extensions of the hinge base have inclined lead-in cam surfaces.

5. A furniture hinge according to claim 1, wherein centering projections are provided on the surface of the hinge base for laterally guiding the lateral limbs of the hinge bracket.

6. A furniture hinge according to claim 5, wherein the hinge bracket is provided in its lower extremity with lateral openings in the region of the centering projections of the hinge base.

7. A furniture hinge according to claim 1, wherein the hinge bracket has two openings in its base limb in which a pair of front extensions of the hinge base pivotally engage, and wherein at least the lateral limbs are resilient and the rear portions thereof are each provided with a spring catch, each spring catch comprising a generally transverse portion connected to the associated lateral limb, the transverse portion merging via a generally upright portion into an angled-over end portion, the latter end portions being engagable beneath a pair of rear extensions of the hinge base to resiliently snap-lock the hinge bracket to the hinge base.

8. A furniture hinge according to claim 1, including a cover member adapted to be clipped onto the hinge bracket so as to at least partially cover the latter, the cover member having a rear portion provided with a securing catch comprising at least one extension which merges into a detent shoulder.

9. A furniture hinge according to claim 8, wherein the cover member has a front portion provided with a hinge and extensions having detent grooves which are adapted to be clipped onto projections of the hinge bracket.

10. A furniture hinge according to claim 8 or 9, wherein the detent shoulders of the cover member are engageable with the spring catches of the hinge bracket when clipped onto the rear extensions of the hinge base, to lock the spring catches to the rear extensions.

11. A furniture hinge according to claim 10, wherein the generally upright portions of the spring catches of the hinge bracket extend between the rear extensions of the hinge base when the hinge bracket is snap-locked to the hinge base, and wherein the at least one securing catch extension of the cover member is engageable between the generally upright portions of the spring catches to resiliently snap-lock the cover member to the hinge bracket.

12. A furniture hinge for hingedly interconnecting first and second relatively movable parts of a piece of furniture, one of which parts comprises a door, said hinge comprising:

(a) a hinge base including (i) a base member securable to the first furniture part, and having a front portion intended to be situated adjacent the second furniture part and a rear portion intended to be situated remote from the second furniture part, at least one front extension projecting longitudinally forwardly adjacent the front portion of the base member, and at least two laterally spaced rear extensions projecting longitudinally rearwardly adjacent the rear portion of the base member, and (ii) a resilient hinge bracket comprising a generally U-shaped stirrup having a pair of lateral limbs interconnected by a front base limb, the front base limb having means engageable by the at least one front extension of the base member to pivotally couple the front of the hinge bracket to the front of the base member, and the rear of each lateral limb having a catch element, the catch elements being resiliently cooperable with the rear extensions of the base member, when the hinge bracket and base member are pivotally coupled together, to snap-lock the hinge bracket to the base member;

(b) hingeable means securable to the second furniture part;

(c) adjustment means interconnecting the hingeable means and the hinge bracket, operable to permit adjustment of the hingeable means relative to the hinge base; and (d) a cover member cooperable with the hinge bracket to at least partially cover the latter, the cover member being connected to the hinge bracket adjacent the front base limb of the latter in a manner permitting the rear portion of the cover member to be hingeable towards and away from the catch elements of the hinge bracket, and the rear portion of the cover member having means to snap-lock the cover member to the hinge bracket.

13. A furniture hinge according to claim 12, wherein the snap-lock means of the cover member is cooperable with the catch elements of the hinge bracket to lock the catch elements to the rear extensions of the base member.

14. A furniture hinge according to claim 13, wherein the catch elements of the hinge bracket are resiliently cammed towards each other, by and between the rear extensions of the base member, to snaplock the catch elements to the rear extensions, and are manually resiliently displaceable towards each other to unlock the catch element from the rear extensions, the cover member including a rear projection releasably engageable between the catch elements to prevent the catch elements from being displaced towards each other and unlocked from the rear extensions.

* * * * *